United States Patent [19]

Brown

[11] Patent Number: 4,666,377

[45] Date of Patent: May 19, 1987

[54] METHOD AND LIFT PUMP AND RAISING LIQUIDS

[75] Inventor: Melvin H. Brown, Allegheny Township, Armstrong County, Pa.

[73] Assignee: Aluminum Company of America, Pittsburgh, Pa.

[21] Appl. No.: 864,546

[22] Filed: May 19, 1986

Related U.S. Application Data

[60] Division of Ser. No. 492,211, May 6, 1983, which is a continuation-in-part of Ser. No. 208,708, Nov. 20, 1980.

[51] Int. Cl.[4] ..... F04F 1/18

[52] U.S. Cl. ..... 417/53

[58] Field of Search ..... 417/108, 109, 110–112, 417/53

[56] References Cited

U.S. PATENT DOCUMENTS

| | | | |
|---|---|---|---|
| 532,699 | 1/1895 | Pohle | 417/109 |
| 1,200,423 | 10/1916 | Huff | 417/109 |
| 2,983,229 | 5/1961 | Went | 417/109 |
| 4,035,103 | 7/1977 | McMurry et al. | 417/109 |

FOREIGN PATENT DOCUMENTS

| | | | |
|---|---|---|---|
| 295906 | 10/1971 | U.S.S.R. | 417/109 |

*Primary Examiner*—Carlton R. Croyle
*Assistant Examiner*—Theodore Olds
*Attorney, Agent, or Firm*—Douglas G. Glantz

[57] ABSTRACT

Disclosed are method and fluid lift pump for raising liquids through a bundle of substantially vertical lift tubes adapted to raise liquids even while submerged less than 50% of total lift height, the tubes having about the same length extending side by side, each tube having an inside diameter of less than about one inch. The lift tubes communicate at the lower end with a housing defining a chamber capable of being filled with liquid to be raised, and the lower portion of the housing includes means for injecting a lifting fluid into the liquid in the chamber. The injecting means comprise an injecting orifice, having an inside diameter no larger than about the largest lift tube inside diameter, positioned below the lower ends of the lift tubes by a specified distance depending on the cross-sectional area of the bundle and the number of injecting orifices. Bubbles of lifting fluid rise through the liquid in the chamber, enter the lift tubes, and form rising slugs of liquid separated by slugs of lifting fluid.

7 Claims, 8 Drawing Figures

METHOD AND LIFT PUMP AND RAISING LIQUIDS

CROSS-REFERENCE TO RELATED APPLICATION

This application is a division of application Ser. No. 492,211, filed May 6, 1983 which is a continuation-in-part of U.S. application Ser. No. 208,708, filed Nov. 20, 1980.

BACKGROUND

This invention relates to a method and apparatus for raising or pumping liquids wherein the pump itself has no moving mechanical parts. In another aspect, it relates to a method and gas lift pump for raising liquids to a height more than twice the submergence depth of the pump. The invention in yet another aspect relates to a method and submergence gas lift pump for raising corrosive liquids.

Many industrial processes include the use of corrosive liquids as an agent in the process or result in corrosive liquids as a product or by-product. Equipment must be suitable for pumping or transferring such corrosive liquids from one vessel or location to another, such as within a plant facility. Corrosion resistant mechanical pumps can be designed specifically for pumping such corrosive liquids; however, such mechanical pumps have disadvantages. For example, packing materials within the pump must be able to withstand the corrosive liquids and may be required to be stable at high temperatures, e.g., such as in excess of 700° C. Such mechanical pumps also have multiple moving parts which must be resistant to the corrosive liquids being pumped. Such features of mechanical pumps add significantly to the cost of manufacturing and of repairing or servicing. As an alternative to mechanical pumps, gas lift pumps having no moving mechanical parts can be used to avoid some of the disadvantages of mechanical pumps.

Conventional gas lift pumps work on a gas lift principle of introducing finely divided gas bubbles into a lift tube to reduce the apparent density of a liquid contained in the lift tube. The liquid (and gas) in the lift tube and a separate body of "parent" liquid, e.g., liquid in a pressure-head-developing standpipe, each act as two arms of a manometer which are of unequal density because of the density change in the lift tube attributable to the addition of gas bubbles in the liquid. A flow of liquid in the manometer ensues up the tube in the direction of the liquid having the gas bubbles contained therein when the product of the parent liquid density multiplied times the depth of submergence, e.g., the height of liquid in a standpipe used to develop the pressure head, is greater than the product of the apparent liquid density multiplied times the length of the lift tubes. Such conventional gas lift pumps alone, i.e., incorporating no more than the gas lift principle, cannot lift liquids to a height significantly greater than the submergence depth of the pump. By "submergence depth" is meant an effective height of liquid which acts to develop and apply a pressure head on the lower end of the lift tube. The effective height of liquid may be provided by liquid contained in a standpipe, in a pool surrounding the lift tube, or by other forms of a pressure-head-developing column of liquid.

Use of the gas lift principle may include introducing small bubbles of the lifting gas directly into the lift tubes, as in U.S. Pat. No. 1,921,060, which discloses a method of purifying metals using reducing gas or inert gas rising through a tubular member filled with impure metal. The rising small bubbles of gas act not only to purify but also to lift the metal to a chamber in which a vacuum is applied. The patent further discloses that a plurality of tubes may be used to increase the rates of treating and of raising the metal by using a multiplicity of tubes operating in parallel. A cascade system is disclosed using multiple tubes operating independently but in series flow.

U.S. Pat. No. 2,399,634 relates to a method of pumping molten metal by submergence gas lift using two connected columns of metal. One column of metal flows downwardly, and the second column of metal flows upwardly in response to a decreased apparent liquid density attributable to rising small gas bubbles entering the second column.

A method and apparatus of degassing molten metals continuously into a vacuum chamber is shown in U.S. Pat. No. 2,893,860. Insoluble gases are injected as small bubbles into a conduit of molten metal to carry the molten metal upwardly through the conduit to the vacuum chamber where the carrying gas and undesired gases are separated, permitting the molten metal to flow back into the original chamber.

Another method of introducing small bubbles of lifting gas directly into lifting tubes is shown in U.S. Pat. No. 3,033,550. A method and apparatus for vacuum treating during degasification of molten metal are disclosed wherein a gas inlet pipe having a plurality of nozzles is disposed below the opening of the rising pipe or lifting tube. A current of gas having a state of fine subdivision is disclosed to be preferred over gas bubbles as large as the inside diameter of the lifting pipe.

A lift pump shown as having bubbles of lifting fluid as large as the inside diameter of the lifting pipe is disclosed in U.S. Pat. No. 1,741,571, which relates to a liquid raising apparatus having a chamber with a lower bowl-like portion and with an upper portion divided by a baffle to form two branches. The lower extremity of the baffle extends horizontally across the chamber. Water enters the chamber through a lower port and rises upwardly until it reaches the lower extremity of the baffle, where it acts to seal air in one branch, which air enters the branch from an inlet port. The apparatus operates by increasing air pressure sufficiently through the air inlet port to cause slugs of water to blow upwardly through the other branch and out through a port. The water slugs are disclosed to be impelled upwardly by the air bubble such that intervals of air flow provide alternate slugs of water and slugs of air rising upwardly through the pipe.

U.S. Pat. No. 4,135,364 discloses an air lift pump energy conversion apparatus having a plurality of vertical lift tubes completely immersed in water. The side by side tubes discharge water upwardly within a hood to drive a small turbine-like motor. Each lift tube has a shorter, smaller diameter inner tube concentric therein and separated from the tube by a horizontal annular fluid-tight partition. Compressed air is introduced into the space between the tubes and below a partition to form a coherent bubble for forcing water into the inner tube. The air then enters the inner tube and passes upwardly into the lower end of the lift tube as a coherent air bubble shown as extending completely across the interior diameter of the lift tube.

U.S. Pat. No. 532,699 discloses a process and apparatus for elevating liquids having a submerged pipe with gas injected at the base, a la the principle used in U.S. Pat. Nos. 1,921,060; 2,399,634; and 2,893,860 presented above, to lift a liquid an additional height less than or equal to the pipe's depth of submergence. A cascade system as mentioned in U.S. Pat. No. 1,921,060 is disclosed.

French Pat. No. 801,935 discloses a liquid elevator device having a lower housing communicating with the lower part of a plurality of conduits which also communicate with an upper housing. Liquid is boiled in each tube to form vapor bubbles in situ along the entire length of the liquid column.

Methods and apparatus incorporating the gas lift principle can be useful for pumping corrosive liquids; however, conventional gas lift pumps have significant problems and drawbacks. Simplicity of construction is an important feature in gas lift pumps especially when the pumps are used for handling corrosive liquids. Conventional lift pumps either lack such simplicity or provide only poor efficiency based on the volume of liquid lifted per volume of lifting fluid injected into the pump. Conventional lift pumps can lift liquids only to a height not significantly greater than the submergence depth of the pump. Conventional lift pumps further lack adequate control of the flow of lifting fluid and the liquid being raised by the pump so as to function as a combined valve and pump capable of regulating the flow rates of liquid and lifting fluid.

SUMMARY OF THE INVENTION

In accordance with the present invention, a fluid lift pump adapted for raising liquids while submerged less than 50% of its total lift height includes a bundle of at least two substantially vertical lift tubes extending side by side with each tube being of about the same length and having an inside diameter of less than about one inch (2.54 cm). The pump includes a lower housing defining a chamber or cavity for containing liquid to be raised and having an upper wall portion through which the lower end of each of the tubes extends to communicate with the chamber. The lower housing includes inlet means for permitting liquid which is to be raised to enter a lower portion of the chamber and for maintaining the liquid in the chamber in a substantially filled condition. The pump includes injecting means for injecting a lifting fluid, e.g., through an orifice inside diameter, of less than about one inch (2.54 cm) and no larger than about the largest lift tube inside diameter, into the chamber at a position below the lower ends of the lift tubes by a distance of at least X as set forth in the equation $$X = \frac{\left[\frac{16A}{\pi}\right]^{0.5}}{n}$$

wherein

A = cross-sectional area of said tube bundle; and n = number of lifting fluid injecting sources uniformly distributed below said bundle.

The method of pumping liquids in accordance with the present invention includes raising liquids by using the fluid lift pump of the present invention and alternatively includes establishing a bundle of at least two tubes of about the same length extending side by side and containing liquid to be raised, each tube having a diameter of less than about one inch (2.54 cm); providing a pressure head to the bottom of the tubes by incorporating a submergence distance of liquid having a height less than 50% the tube height; injecting a lifting fluid, through an orifice, of an injecting diameter of less than about one inch (2.54 cm) and no larger than about the largest lift tube inside diameter, at a position below the tubes at a distance of at least X as set forth in the equation $$X = \frac{\left[\frac{16A}{\pi}\right]^{0.5}}{n}$$

wherein

A = cross-sectional area of said tube bundle; and n = number of lifting fluid injecting sources uniformly distributed below said bundle to form gas bubbles over a uniform distribution of the tubes and to lift said liquid to the top of said tubes.

The present invention satisfies the objective of providing an improved gas lift pump which moves more liquid per unit volume of compressed lifting fluid. By using relatively small diameter tubes and entraining bubbles equaling the diameter of the tube, slippage is reduced, i.e., the differential velocity between the bubbles and the liquid is reduced from that which would occur if the bubble diameter were smaller than the tube diameter. The surface tension of the liquid being pumped, as well as the change in density, assists movement of the liquid through the tubes. Furthermore, the present invention provides efficient pumping as disclosed hereinafter at a submergence depth less than 50% the lift tube height.

FIGS. *2a* and *2b* are schematic representations of various lifting fluid injector configurations.

Figure 1:
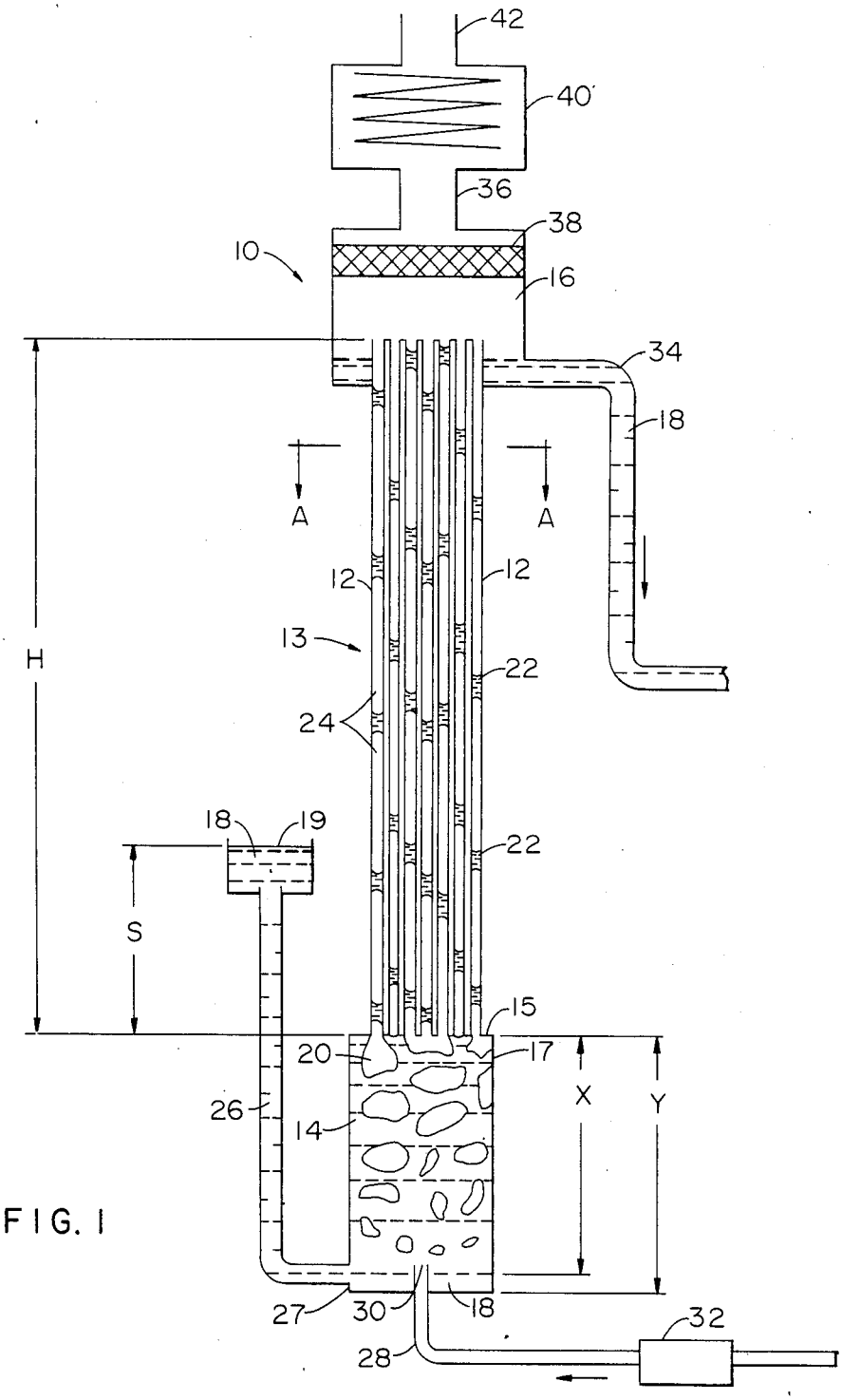
FIG. 1 is a schematic of the lift pump of the present invention.
Figure 3:
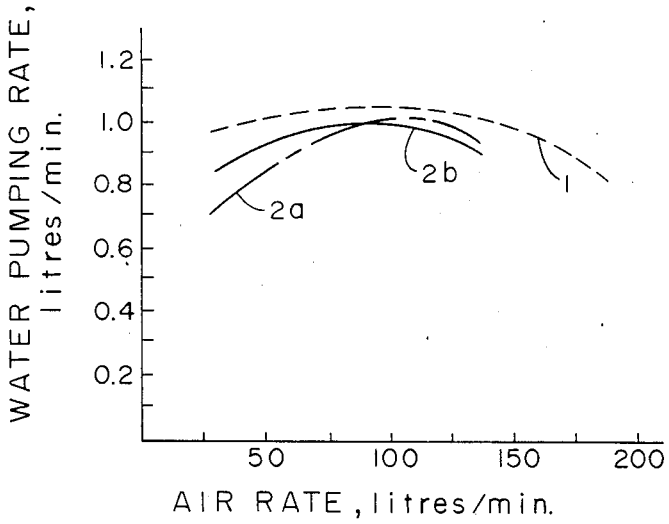

FIG. 3 is a graphic comparison of the various injector configurations of FIGS. 1, *2a*, and *2b*.

Figure 4:
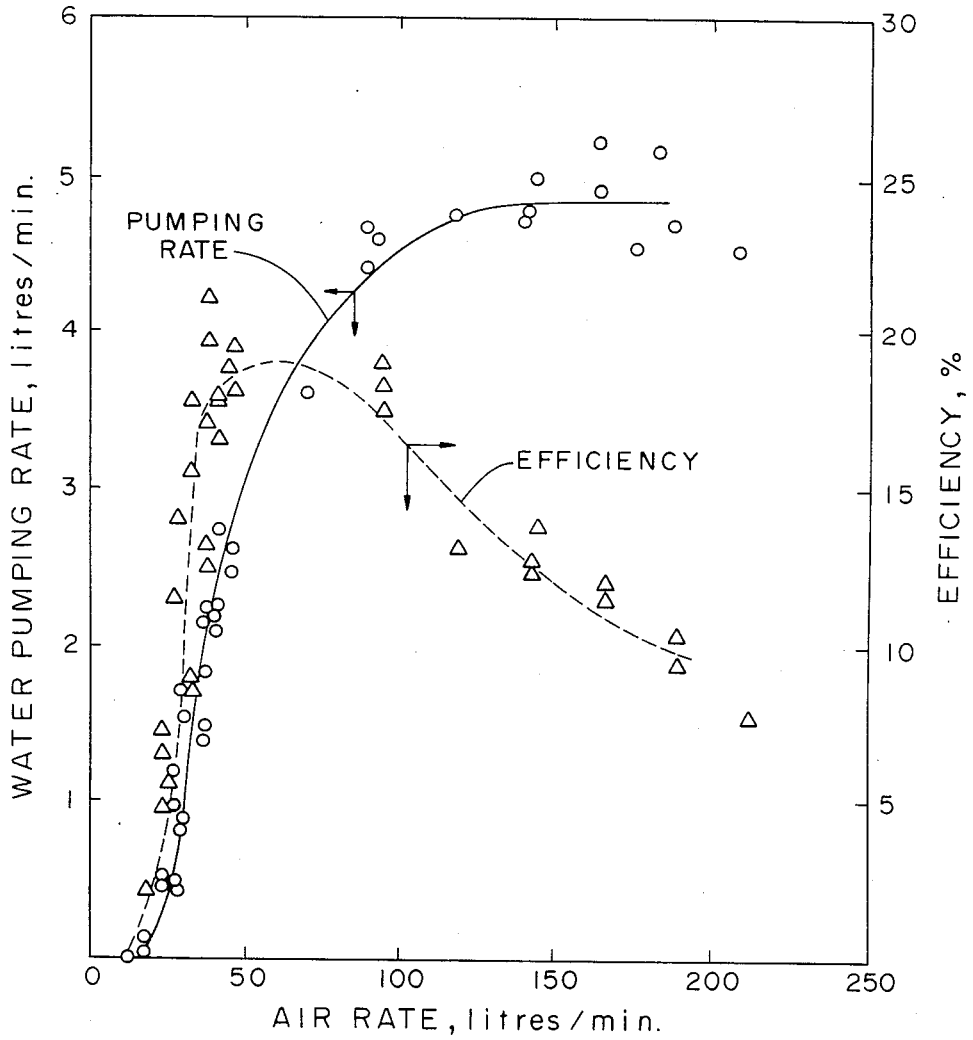

FIG. 4 is a graphic illustration of the pumping rate and efficiency of the present invention.

Figure 5:
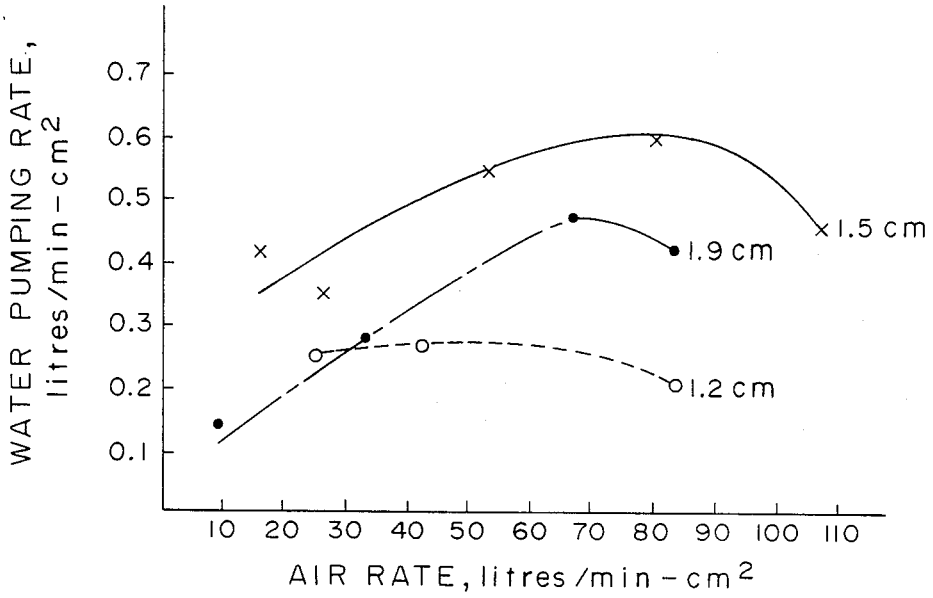
Figure 6:
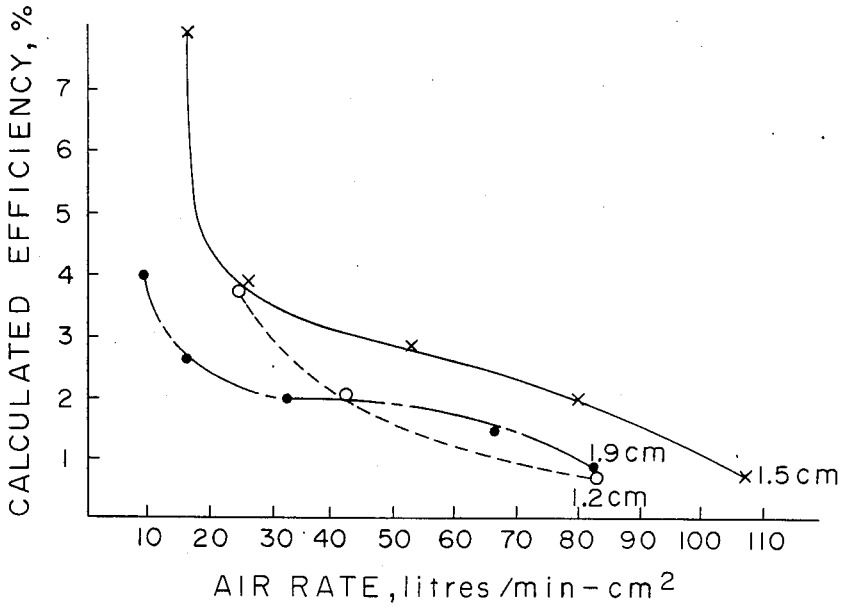

FIGS. 5 and 6 are graphic illustrations of comparative pumping rates and efficiencies for various lift tubes in a lift pump of the present invention.

DETAILED DESCRIPTION

Referring to FIG. 1, one embodiment of the gas lift pump of the present invention is illustrated. Generally, lift pump 10 includes a bundle 13 of a plurality of substantially vertical lift tubes 12 for raising slugs 22 of liquid 18 separated by slugs 24 of lifting fluid 20 from a common lower housing 14 to an upper housing 16. The lower ends of lift tubes 12 are located a submergence depth or distance "S" lower than the surface 19 of liquid 18 to be raised by pump 10. The submergence depth provides pressure head for pumping. Lift tubes 12 raise liquid 18 a total lift height or distance "H" equal to the length of the lift tubes as measured from the lower ends communicating with lower housing 14 to the upper ends located within upper housing 16.

Lift tubes 12 are substantially vertical and extend side by side with each tube being about the same length. Lift tube 12 has a relatively small inside diameter. By small is meant that the inside diameter of the tube is less than about one inch (2.54 centimeters). For water as the liquid to be raised in lift pump 10 of the present invention, the inside diameter of the lift tubes should range from about 0.4 to about 1.9 cm with a preferred diameter sized in the range of about 1.3 cm to about 1.7 cm, i.e., an inside diameter of about 1.5 cm±2 cm. For liquids having a viscosity greater than the viscosity of water, generally the preferred inside diameter of the lift tubes should be only slightly larger than those used for lifting water, and should be less than about one inch (2.54 cm).

The number of lift tubes 12 to be used in the present invention is dependent upon the desired capacity for lift pump 10 and the pressure head available for the pumping system. Preferably, two or more lift tubes 12 are arranged such as in bundles 13 or groups for increased capacity.

Figure 1A:
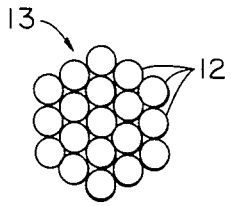
FIG. 1*a* is a cross-sectional view of a bundle of lifting tubes.

A bundle 13 of tubes 12 is employed to provide the most compact arrangement with tubes 12 contacting adjacent tubes. The entire bundle 13 may resemble a substantially cylindrical shape of side by side tubes 12. FIG. 1*a* illustrates a cross-sectional view A—A of bundle 13 of FIG. 1 with the tubes of bundle 13 arranged generally in a circular pattern. The outer periphery of bundle 13 encloses the area of the bundle.

Lift tubes 12 communicate with a common lower housing 14 through an upper wall portion 15 of housing 14. Housing 14, which includes at least an upper wall portion 15 and downwardly extending side wall portions 17, defines a cavity or a substantially closed chamber for containing the liquid to be raised. Housing 14 may define a cavity which is substantially open in its lower portion to provide an inlet means to permit liquid 18 to enter and fill the cavity. In the alternative and as shown in FIG. 1, housing 14 may be substantially closed (including its lower portion) to define a chamber for containing the liquid to be raised. Housing 14 has in its lower portion an inlet means 27 for introducing liquid 18 into housing 14 and for maintaining liquid 18 in a filled condition in housing 14. The inlet means for introducing liquid 18 may include an inlet tube 26 in the side wall or bottom wall of lower housing 14. Liquid 18 may be subjected to ambient pressure and gravity or pressurized to facilitate its flow into housing 14.

Pump 10 further includes a means for injecting the lifting fluid 18 into the cavity or chamber at a location below upper wall portion 15 and spaced a specified distance from upper wall portion 15 of housing 14 and spaced above inlet means 27 to prevent gas flow up inlet tube 26. Preferably, the means for injecting a lifting fluid includes an injection tube 28 terminating with an orifice 30 opening into housing 14. As shown in FIG. 1, tube 28 may protrude a short distance into the lower portion of lower housing 14, such as through the bottom wall thereof before terminating with orifice 30. The diameter of orifice 30 and injection tube 28 may vary depending on the particular liquid 18 to be raised and depending on the inside diameter of lift tubes 12. Orifice 30 is sized such that lifting fluid 20 entering lower chamber 14 through injection tube 28 forms bubbles of lifting fluid 20 rising within liquid 18. Generally, the size or diameter of orifice 30 is equal to or slightly smaller than the inside diameter of lift tubes 12 since fluid bubbles formed by the orifice enlarge as they rise through the liquid. Otherwise, i.e., if the orifice is much larger than the lift tube inside diameter, liquid may be blocked from entering the lift tubes. Some fluid bubbles merge with other fluid bubbles to form larger bubbles in liquid 18. Lift tubes 12 have an inside diameter of less than about one inch (2.54 cm) and preferably in the range of 1.5 cm±2 cm, and the diameter of orifice 30 should be less than about the inside diameter of lift tube 12, i.e., less than about one inch (2.54 cm), and preferably in the range of about 1.3 cm±4 cm, but no larger than the lift tube inside diameter, e.g., to form bubbles which rise through a distance of about 15.2 cm in housing 14 to enter the lower end of lift tubes 12.

The present invention can provide a plurality of orifices 30 for injecting lifting fluid 18 into the cavity or chamber of housing 14. For bundles 13 having a substantial number of lift tubes 12, for example, 10 or more, it is advantageous to have multiple orifices 30 for injecting fluid 18 into housing 14. Preferably, the multiple orifices are uniformly distributed below tube bundle 13.

Orifice 30 of injection tube 28 opens into the lower portion of lower housing 14 so that bubbles of lifting fluid 20 rise a substantial distance through liquid 18 before the bubbles enter the lower ends of lift tubes 12. By substantial it is meant that bubbles rise a distance of at least X as set forth in equation (1) below. For example, as shown in FIG. 1, injection tube 28 protrudes upwardly through the bottom wall of lower chamber 14 to a distance X below the lower ends of lift tubes 12. Distance X is calculated from the following equation (1):

$$X = \frac{\left[\frac{16A}{\pi}\right]^{0.5}}{n} \tag{1}$$

where

A = the cross-sectional area of the tube bundle, n = number of orifices uniformly distributed below the bundle.

If orifice 30 of injector tube 28 is too close to the lower ends of lift tubes 12, the pumping rate and efficiency of lift pump 10 are reduced because the bubbles do not uniformly distribute within housing 14 and liquid 18 before entering tubes 12. If orifice 30 is too far away, the efficiency is reduced because of increased bubble size which blocks liquid from entering the lift tubes.

Side walls 17 of lower housing 14 must extend downwardly a distance at least to the level of orifice 30 of tube 28 for a closed housing 14 and at least below that level for housing 14 defining a cavity with no lower wall portion. As shown in FIG. 1, side walls 17 extend downwardly a distance Y from upper wall 15 of lower housing 14 and lower ends of lift tubes 12. Distance Y of side walls 17, which may also extend laterally, should be at least equal to distance X measured to orifice 30 for a substantially closed housing 14. If the side walls are not long enough so as not to extend below the level of orifice 30, then bubbles of lifting fluid 20 from orifice 30 may escape the cavity of housing 14 around the lower edges of side walls 17. Such escape of bubbles would result in a reduced efficiency and a reduced pumping rate of liquid 18.

Figure 2A:
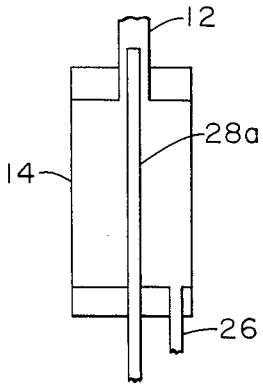
Figure 2B:
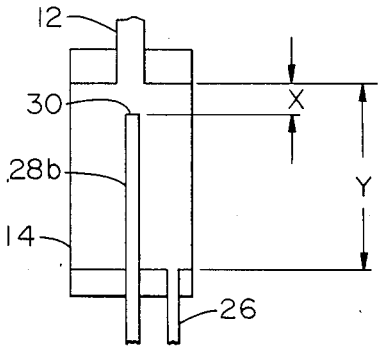

FIGS. 2*a* and 2*b* illustrate two other configurations of injector tube 28 in chamber 14. FIG. 2*a* shows lower housing 14 receiving injector tube 28*a* that extends upwardly into lift tube 12 for releasing bubbles of lifting fluid 20 directly into lift tube 12. FIG. 2*b* differs from FIG. 2*a* in that injector tube 28*b* extends a substantial distance through chamber 14 with orifice 30 in close proximity to the lower end of lift tube 12.

FIG. 3 illustrates in graphic form a comparison of pumping rates of the injector tube configurations of FIGS. 1, 2*a*, and 2*b* in a plot of liquid pumping rate versus lifting fluid injection flow rate. The liquid pumped is water, and the lifting fluid is air. FIG. 3 shows that the injector tube configuration in accordance with the present invention as shown in one embodiment in FIG. 1 pumps more liquid, over the entire range of air flow rates, than the configurations of FIGS. 2*a* and 2*b*. Housing 14 in each configuration was substantially closed as shown in FIG. 1 and had a depth Y of 15.2 cm and a diameter of 6.4 cm with an injector tube diameter of 1.3 cm and a single lift tube 12 of 1.5 cm inside diameter extending through the upper wall of housing 16. Each configuration was used to pump water with air as a lifting fluid with a 0.6 m submergence distance and a lift tube 2.4 m high.

Lifting fluid 20 entering chamber 14 can be monitored and regulated to control the liquid pumping rate. For example in one embodiment, a flow meter 32, interposed along injection tube 28 between orifice 30 and the fluid source, regulates the rate of flow and volume of lifting fluid 20 injected into lower chamber 14 as shown in FIG. 1 to control the rise of liquid up lift tubes 12.

While the overall size of lower housing 14 is not critical to the operation of lift pump 10 of the present invention, lower housing 14 must have a configuration which facilitates the rising of bubbles of lifting fluid 20 from injection tube 28 into lift tubes 12. The lower ends of lift tubes 12 communicate with chamber 14 and locate the submergence depth or distance "S" below surface 19 of liquid 18. The pressure head for pumping liquid 18 can be calculated as the product of the density of liquid 18 and the depth of submergence "S". For all purposes herein, submergence depth "S" includes arrangements including, inter alia, wherein chamber 14 and the lower ends of lift tubes 12 are immersed and submerged, e.g., surrounded, within liquid 18 or alternatively where, as shown in FIG. 1, the lower ends of lift tubes 12 are not submerged but are located outside and below surface 19 of liquid 18 with inlet tube 26 of chamber 14 communicating with a source of liquid 18.

Upper housing 16 may receive and communicate with the upper ends of lift tubes 12 as shown in FIG. 1. Preferably, lift tubes 12 protrude through a lower wall portion of upper housing 16 and extend substantially into upper housing 16. Liquid 18 rising up lift tubes 12 spills out of the tubes and into upper housing 16 which may also include a fluid outlet tube 36 for removal of lifting fluid 20 separately from liquid 18. Liquid outlet tube 34 permits drainage of liquid 18 raised and spilled into upper housing 16.

Demister 38 and condenser 40 in upper housing 16 separate lifting fluid 20 from liquid 18 after being raised. Demister 38 separates out droplets of raised liquid, and condenser 40 recovers vapors of the raised liquid from lifting fluid 20. For example, if the liquid to be raised is a metal chloride, e.g., aluminum chloride, and the lifting fluid is nitrogen, the demister and condenser may be used to recover metal chloride being carried by the nitrogen, and the nitrogen can be recycled and reused as lifting fluid in lift pump 10.

It is within the scope of the present invention that lift pump 10 is capable of operating with liquid 18 and lifting fluid 20 chosen from a variety of materials. For example, liquid 18 may be water, corrosive liquids, or molten metals or molten metal salts. Lifting fluid 20 may be any fluid, gas or liquid, which is lighter than and has a lower density than liquid 18. Preferably, lifting fluid 20 is a gaseous material so that the difference in actual densities between lifting fluid 20 and liquid 18 is relatively large. The larger the relative difference in densities, the greater the effect will be on the apparent density of liquid 18 rising in lift tubes 12. Preferably, lifting fluid 20 is inert with respect to liquid 18. By inert, it is meant that the lifting fluid substantially does not enter into chemical reaction with liquid 18 which is to be raised by lift pump 10. It is also preferred that lifting fluid 20 is substantially insoluble in liquid 18.

Operation of lift pump 10 of the present invention can be initiated after submergence of lift pump 10 a depth or distance "S" below or lower than surface 19 of liquid 18. As discussed above, lift pump 10 may be submerged (not shown) within liquid 18. Alternately, as shown in FIG. 1, lift pump 10 may not be submerged but, instead, liquid 18 to be raised can be contained in a liquid standpipe, e.g., inlet tube 26 communicating through inlet means 27 between lower chamber 14 and liquid 18. Submergence of lift pump 10 fills chamber 14 with liquid 18, some of which may also fill the lower ends of lift tubes 12.

To begin pump operation, lifting fluid 20 begins to flow through inlet tube 28 and through orifice 30 in intervals sufficient to form bubbles flowing into lower chamber 14 containing liquid 18. Bubbles of lifting fluid 20, which are inert, insoluble, and lighter than liquid 18, rise through liquid 18 in lower chamber 14 to the vicinity of the lower end of lift tubes 12. Bubbles of lifting fluid 20 expand as they rise through liquid 18 in lower chamber 14 until the diameter of each bubble is equal to or greater than the inside diameter of lift tubes 12. Some of the bubbles also merge with other bubbles to form larger bubbles. The rising bubbles enter lift tubes 12 and trap liquid 18 between bubbles of lifting fluid 20 rising through lift tubes 12. In this way, liquid 18 is trapped between entraining bubbles and forms alternate slugs 22 of liquid 18 and slugs 24 of lifting fluid 20 rising in lift tubes 12. The apparent density of the mixture of liquid 18 and fluid 20 in the plurality of lift tubes 12 is less than the actual density of liquid 18 because of the entrained bubbles of lifting fluid separating liquid slugs 22.

Lift tubes 12 have an inside diameter less than about one inch (2.54 cm). The graphic illustrations of FIGS. 5 and 6 depict data observed for the operation of a lift pump in accordance with the present invention. Lift tubes having a 2.4 m vertical lifting height were used. A pressure head of 0.6 meter of liquid to be raised was applied at the lower tube end. Lifting fluid flow rates were varied over a wide range, and liquid pumping rates were observed. Air, as the lifting fluid, was introduced at a position 15.3 cm below the lift tube's lower end at flow rates ranging from 28 to 236 l/min. Water, as the raised liquid, was pumped through various lift tubes of different inside diameters. Pumping rates were observed and efficiencies calculated. The results are shown in FIGS. 5 and 6.

It has been found that lift tubes having a specified inside diameter of about 1.5 cm±2 cm, i.e., an inside diameter in the range of about 1.3 cm to about 1.7 cm, provide a higher water pumping rate and higher calculated efficiency at all air rates in the lift pump and method of the present invention, which higher pumping and efficiency rate are attributable to such specified inside diameter in combination with the method and pump of the present invention.

The characteristics and properties, such as density and viscosity, of the particular liquid to be raised have only a very slight effect on the size of the lift tube. The equation for calculating the height (h) to which a liquid will rise in a capillary tube is shown as follows in equation (2):

$$h = \frac{2T}{rdg} \tag{2}$$

where h=height—cm,

T=surface tension—dynes/cm, r=radius—cm, d=density—g/cm$^3$, g=acceleration of gravity—980 cm/sec$^2$.

Calculated values of h using equation (2) for water (having T=71.8 dynes/cm and d=1.000 g/cm$^3$) at various tube diameters ranging from 0.25 cm to 4 cm are given in Table I. The largest diameter tube in which a slug of water can be held in stable condition by surface tension is about 0.5 cm. The calculations in Table I suggest that the limit of stability occurs at a ratio of h/D of about 1. Thus, as the tube diameter is increased beyond the point where D=h, it becomes more difficult to suspend a slug of water within the tube. Since gas leaks past the slugs of liquid and thereby reduces efficiency, it would be desirable to use tube diameters not larger than D=h. However, since friction increases rapidly as tube diameter decreases, diameters slightly larger than D=h are employed to achieve reasonable pumping rates.

The calculated values of D (where h/D=1) for six compounds or elements are given in Table II. Although the surface tension (T) varied from 17.6 dynes/cm to 539.0 dynes/cm and density (d) varied from 0.713 g/cm$^3$ to 13.546 g/cm$^3$, the values of D (where h/D=1) only varied from 0.258 to 0.541 cm. Even though surface tension and density varies widely, the values of D in most cases were on the same order of the value of D for water, i.e., about 0.5 cm. Moreover, the observed variation (of D for the liquids of widely varying liquid properties) tended to be less than the D of water, i.e., less than 0.5 cm. Such a lower D than the D for water indicates a lift tube inside diameter slightly smaller than that for water. These results suggest that the data for pumping rates and efficiencies obtained with water should be applicable to a wide range of liquids as far as tube inside diameter is concerned, i.e., an inside diameter of less than about one inch (2.54 cm).

TABLE I

| D (cm) | h (cm) | h/D |
|---|---|---|
| 0.25 | 1.172 | 4.688 |
| 0.50 | 0.586 | 1.172 |
| 1.00 | 0.293 | 0.293 |
| 2.00 | 0.147 | 0.0735 |
| 4.00 | 0.0733 | 0.0183 |

TABLE II

| Compound or Element | T (dynes/cm) | d (gm/cm$^3$) | D (cm) (at h/D = 1) (h = (4T/dg)$^{0.5}$) |
|---|---|---|---|
| Water | 71.8 | 1.000 | 0.541 |
| Carbon tetrachloride | 26.1 | 1.595 | 0.258 |
| Ethyl alcohol | 21.8 | 0.789 | 0.336 |
| Benzene | 28.2 | 0.879 | 0.362 |
| Ethyl ether | 17.6 | 0.713 | 0.317 |
| Mercury | 539.0 | 13.546 | 0.403 |

For water as the liquid to be raised in lift pump 10 of the present invention, the inside diameter of the lift tubes should range from about 0.4 to about 1.9 cm with a preferred diameter in the range of about 1.3 cm to about 1.7 cm, i.e., at an inside diameter of about 1.5 cm±2 cm. For liquids having a viscosity or density greater than that of water, generally the preferred inside diameter of the lift tubes should be the same as or only slightly larger than those used for lifting water, and should be less than about one inch (2.54 cm).

As the pumping operation proceeds to form rising liquid slugs 22, the ratio of the volume of lifting fluid 20 to the volume of liquid 18 in the cavity or chamber of lower housing 14 may vary until it reaches steady state condition commensurate with the pressure and flow rate of lifting fluid 20. The volume of lifting fluid 20 will be generally substantially greater than the volume of liquid 18 during most of the pumping operation after start-up.

The flow rate and pressure of lifting fluid 20 entering lower chamber 14 through orifice 30 can control the flow of liquid 18 being pumped by lift pump 10. Lifting fluid flow rates which are too high cause foaming of liquid 18 within lower chamber 14. Foaming or the formation of finely divided gas bubbles is detrimental to the formation of slugs 22 and 24 rising up lift tubes 12. Lifting fluid flow rates which are too low are insufficient to commence liquid flow or movement up lift tubes 12. Preferably, lifting fluid 20 is injected into lower chamber 14 at a fluid flow rate commensurate with slug formation. Lifting fluid 20 is injected under pressure into chamber 14 through orifice 30. Pressures which are too high cause a drop in efficiency. Pressures which are too low also cause a drop in efficiency and a reduction in pumping rate. Preferably, lifting fluid 20 is injected at a pressure to facilitate slug formation. Both the pressure and flow rate of liquid 20 may be dependent upon the particular lifting fluid and liquid to be raised. For using air as a lifting fluid for raising water, the air flow rate may range from 0.45 to 4.5 feet$^3$/minute-inch$^2$ (2.0 to 20.0 liter/minute-centimeter$^2$) and the pressure may range from 1 to 7 psi (6.9 to 48.3 kPa).

As the slugs 22 of liquid 18 and slugs 24 of lifting fluid 20 reach the upper end of lift tubes 12, liquid 18 spills out of the top of tubes 12 and into upper chamber 16. Liquid 18 is received within upper chamber 16 and can be drained away through liquid outlet tube 34. Lifting fluid 20 may exit upper chamber 16 through fluid outlet tube 36. Preferably, and as shown in FIG. 1, lifting fluid 20 may pass through demister 38 for filtering out liquid droplets from the lifting fluid. Furthermore, lifting fluid 20 may pass through condenser 40 which cools the lifting fluid 20 to condense out and recover vapors of the raised liquid, for example, metal chloride vapors, which may be carried by the lifting fluid, such as nitrogen. Lifting fluid 20 then can be passed through fluid outlet tube 42 to be collected and reused as a lifting fluid in lift pump 10.

FIG. 4 illustrates in graphic form pumping rate (data in circles) and efficiency (data points in triangles) over a range of flow rates for lift pump 10 of the present invention having seven lift tubes 12 of 36 ft. (11 m) height "H" and 8 ft. (2.4 m) submergence depth "S" as shown in FIG. 1. Upper chamber 16 did not include a demister or condenser unit. Lower chamber 14 had a depth of 1.5 cm. Each lift tube had an internal diameter of 1.5 cm, and the lifting fluid inlet tube had an orifice diameter 1.3 cm. Water was pumped by bubbling air as the lifting fluid through chamber 14 at a pressure range of 3.2 to 3.6 psi (21 to 25 kPa).

The efficiency of the lift pump was calculated from the ratio of the amount of work in the raised water to the amount of work in the lifting air. The amount of work in the water is the work necessary to lift the water to a height of H minus S. The amount of work in the air is the work required to compress the air and can be calculated by the following equation (3):

$$W = k\frac{P_1V_1}{k-1}\left[\frac{P_2^{\frac{(k-1)}{k}}}{P_1} - 1\right] \quad (3)$$

where

W=work in foot-pounds, $P_1$=initial pressure, $P_2$=final pressure, $V_1$=initial volume, $k=C_P/C_V$=specific heat at constant pressure/-specific heat at constant volume=1.40 for air.

During the pumping operation, it has been found that lifting fluid flow rates in the range of about 2.5 liters/-minute-cm$^2$ to about 12.0 liters/minute-cm$^2$ are preferred, and lifting fluid flow rates in the range of about 4.0 liters/minute-cm$^2$ to about 8.0 liters/minute-cm$^2$ are more preferred, to achieve pumping or lifting with high efficiency. The flow rate unit measure of liters/minute-cm$^2$ refers to liters per minute per square centimeter of lift tube inside area.

The pumping rates and efficiency of the lift pump of the present invention can be controlled by changing pressure head (submergence depth or distance), height of lift tubes, the number of lift tubes, or a combination of such adjustments. As shown in FIG. 4, the lift pump of the present invention in one embodiment functions to raise liquids with a submergence of about 22% of the total height of lift tubes 12. Generally for the present invention, submergence depth may range from as low as about 13% up to about 50% or more whereas a conventional lift pump requires 50% or more submergence.

Lift pumps 10 also may be arranged in series to lift fluid 18 to greater heights without increasing the length or height of lift tubes 12. For example, by placing successive pumps 10 at higher levels, liquid outlet 34 of one pump could feed liquid 18 into liquid inlet tube 26 of an adjacent pump 10.

Lift pump 10 of the present invention further has the advantage of being a combined pump and valve in which the flow of liquid 18 is controlled by the rate of flow of lifting fluid 20. Valving is accomplished by using variations in flow rates of lifting fluid 20 to control the flow of liquid 18 being raised in lift tubes 12.

Although specific embodiments and alternative embodiments have been described, the scope of the present invention should not be construed as limited to those embodiments but also should include other embodiments which can be made to function within the scope of the present invention.

What is claimed is:

1. A method of pumping liquids comprising:

establishing a bundle of at least two lift tubes of about the same length extending side by side and containing liquid to be raised, each tube having a diameter of less than about one inch;

providing a pressure head to the bottom of said tubes by incorporating a submergence depth of liquid having a height less than 50% the height of said tube; and injecting a lifting gas through an orifice having a diameter of less than about one inch located at a position below said tubes at a distance of at least X as set forth in the equation:

$$X = \frac{\left[\frac{16A}{\pi}\right]^{0.5}}{n}$$

wherein

A=cross-sectional area of said tube bundle; and n=number of orifices uniformly distributed below said bundle to form gas bubbles over a uniform distribution of said tubes and to lift said liquid to the top of said tubes.

2. A method as set forth in claim 1 further comprising recovering said lifting gas from raised liquid by collecting entrained liquid droplets on a demister and by condensing vapors of said liquid in a condenser.

3. A method as set forth in claim 2 further comprising recycling recovered gas to said injecting means.

4. A method as set forth in claim 3 further comprising adjusting gas flow rate through said orifice.

5. A method as set forth in claim 4 wherein said lift tubes have an inside diameter in the range of about 1.3 cm to about 1.7 cm.

6. A method according to claim 5 wherein said gas flow rate falls in the range of about 2.5 liters/minute-cm$^2$ to about 12.0 liters/minute-cm$^2$.

7. A method according to claim 4 wherein said gas flow rate falls in a range of from about 4 liters/minute-cm$^2$ to about 8 liters/minute-cm$^2$.

* * * * *